US005207901A

United States Patent [19]

Ravagnan

[11] Patent Number: 5,207,901

[45] Date of Patent: May 4, 1993

[54] WATERCRAFT BUCKET FOR COLLECTING FLOATING MATERIALS

[75] Inventor: Giancarlo Ravagnan, Padova, Italy

[73] Assignee: O.C.S. Officine Costruzioni Speciali S.p.A., Albignasego, Italy

[21] Appl. No.: 822,815

[22] Filed: Jan. 21, 1992

[30] Foreign Application Priority Data

Jan. 22, 1991 [IT] Italy ..... 000015 A/91

[51] Int. Cl.[5] ..... E02B 15/04

[52] U.S. Cl. ..... 210/173; 210/242.1; 210/242.3; 210/416.1; 210/923; 405/60

[58] Field of Search ..... 210/153, 170, 173, 242.1, 210/242.3, 256, 258, 259, 261, 298, 299, 359, 391, 407, 416.1, 923; 405/60

[56] References Cited

U.S. PATENT DOCUMENTS

| | | | |
|---|---|---|---|
| 3,268,081 | 8/1966 | Menkee et al. | 210/242.1 |
| 3,326,379 | 6/1967 | Caddick | 210/242.1 |
| 3,434,444 | 3/1969 | Caddick | 114/57 |
| 3,700,108 | 10/1972 | Richards | 210/242.3 |
| 3,722,688 | 3/1973 | Wirsching | 210/923 |
| 3,731,813 | 5/1973 | Tipton | 210/242.3 |
| 3,853,768 | 12/1974 | Bagnuto | 210/923 |
| 4,032,449 | 6/1977 | De Visser et al. | 210/173 |
| 4,141,308 | 2/1979 | Gainey | 210/923 |
| 4,360,429 | 11/1982 | Morris | 210/923 |
| 4,363,735 | 12/1982 | Hook | 210/242.1 |
| 4,456,536 | 6/1984 | Lorenz et al. | 210/923 |
| 4,473,469 | 9/1984 | Ayroldi | 210/923 |
| 5,078,863 | 1/1992 | Durigon | 210/242.1 |

FOREIGN PATENT DOCUMENTS

| | | |
|---|---|---|
| 590252 | 1/1960 | Canada . |
| 2089471 | 1/1972 | France . |
| 2480821 | 10/1981 | France . |
| 52-49588 | 4/1977 | Japan . |
| 2-95999 | 4/1990 | Japan . |
| 8404938 | 12/1984 | PCT Int'l Appl. . |
| 2088737 | 6/1982 | United Kingdom . |

*Primary Examiner*—Stanley S. Silverman
*Assistant Examiner*—Christopher Upton
*Attorney, Agent, or Firm*—Guido Modiano; Albert Josif

[57] ABSTRACT

Watercraft bucket including a loader which is arrangeable on the watercraft so that it is partially submerged under the water surface during the advancement thereof. The loader has a sieve-like bottom and a lower section configured like a depression chamber with at least one ejector which continuously expels the conveyed water.

7 Claims, 2 Drawing Sheets

WATERCRAFT BUCKET FOR COLLECTING FLOATING MATERIALS

BACKGROUND OF THE INVENTION

The present invention relates to a watercraft bucket for collecting floating materials.

It is known that the need to eliminate the causes of the pollution of waters, be they marine surfaces or inland waters of basins or rivers, is currently very urgent and strongly felt.

This need is all the more felt in recent times, due to a considerable algal florescence which occurs particularly in summer periods on the surface of the Adriatic sea and of the Venetian lagoon, causing considerable problems from the point of view of both navigation and bathing.

These algae furthermore form a film on the surface of the water which prevents the exchange of oxygen between the air and the water and ultimately causes havoc in the environment, preventing the life o aquatic flora and fauna.

SUMMARY OF THE INVENTION

The aim of the present invention is to provide a device which can collect algae or other floating materials and deposit them in a collection container.

A consequent primary object is to provide a device which is capable of separating the collected substances from the water.

Not least object is to provide a device which is structurally simple and easy to install.

This aim, these objects and others which will become apparent hereinafter are achieved by a watercraft bucket for collecting floating materials, characterized in that it comprises a loader which is arranged at the bow or in another position on the watercraft and is suitable for being arranged so that it is partially submerged during the advancement of said craft; said loader having a sieve-like bottom and a lower section configured like a depression chamber with at least one ejector suitable for expelling the conveyed water.

BRIEF DESCRIPTION OF THE DRAWINGS

Further characteristics and advantages of the invention will become apparent from the detailed description of an embodiment thereof, illustrated only by way of nonlimitative example in the accompanying drawings, wherein.

DESCRIPTION OF THE PREFERRED EMBODIMENTS

Figure 1:
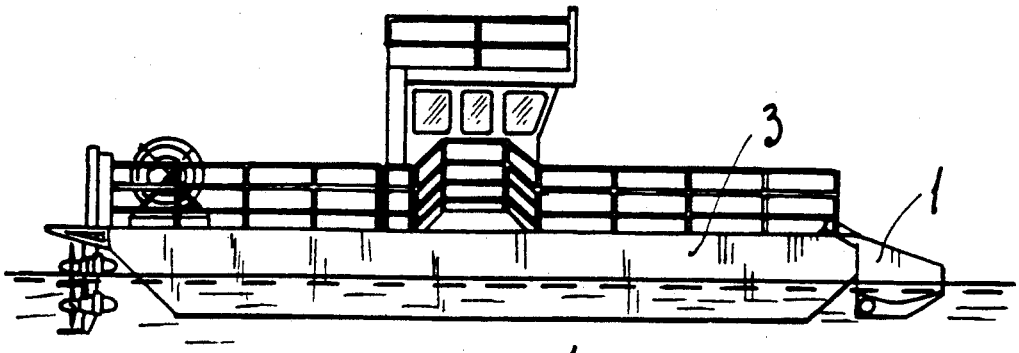
FIG. 1 is a schematic side view of a watercraft for collecting floating materials which is provided, at the bow, with the bucket according to the invention.

With reference to the above FIGS. 1 to 4, the bucket according to the invention comprises a loader 1 having a lower section 6 and a rear wall and side walls extending upwardly from the lower section, and an open front. The loader bucket 1 is further provided with arms 2 which are articulated to a bow region of a watercraft 3 suitable for collecting floating materials.

Figure 2:
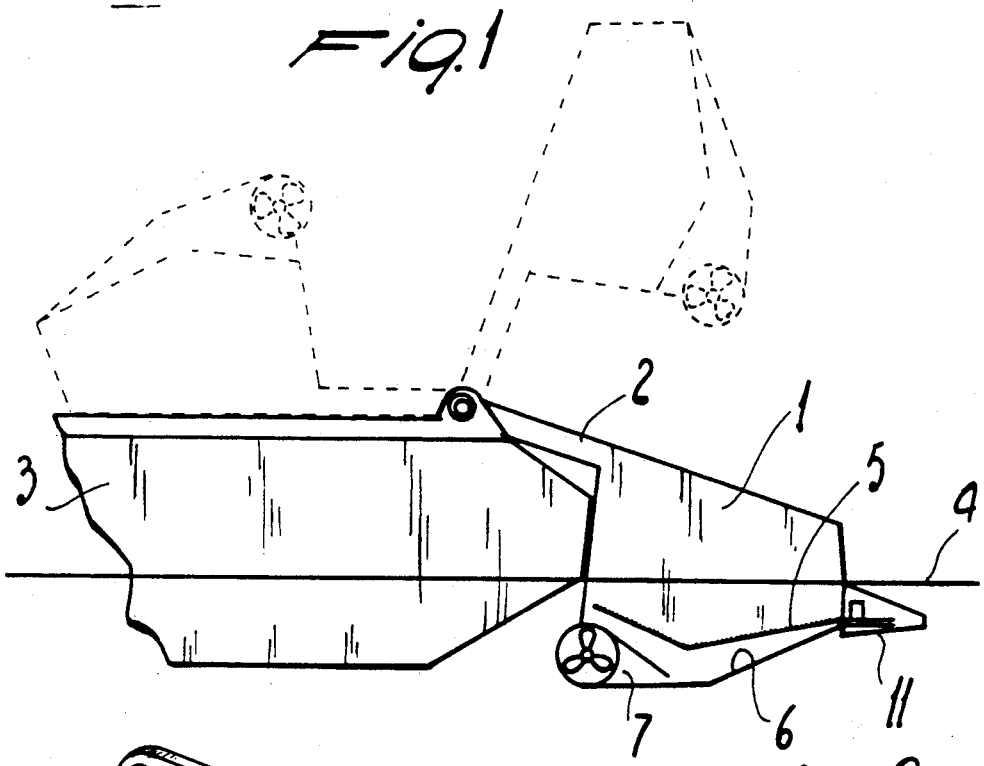
FIG. 2 is an enlarged side view of a detail of the watercraft of FIG. 1, with the bucket according to the invention.

Articulation is performed about a transverse axis so that the loader 1 can be overturned by suitable actuation means, according to the movements indicated by the broken lines in FIG. 2, parallel to the axis of the watercraft 3.

The loader 1 is suitable for being arranged so that its walls are partially submerged in front of the watercraft 3 during the advancement thereof and so that a surface portion of water is conveyed into it through the open front thereof.

In a region below the surface 4 of the water, said loader 1 is provided with a sieve-like bottom 5 which has its concavity directed upward and is constituted for example by a grille, by a net or by fabric.

The sieve-like bottom can conveniently be replaceable.

Beneath the bottom 5, the lower section 6 of the loader has a concave shape in which a double channel system defined below a plate extending from the loader bucket rear wall below the sieve bottom 5, 7 is defined at the rear; said channel system forms a sort of cylindrical depression chamber in which one or more ejectors 8 are installed; said ejectors are suitable for expelling the water, conveyed through a longitudinal opening extending between the edge of the plate and the lower section along the width of the lower section, out of two outlets of the cylindrical chamber laterally from the loader 1 or in any other direction.

Each of the ejectors 8 is conveniently constituted by a propeller 9 which is motorized by means of a variable-speed orientatable hydraulic motor 10.

Instead of being fixed, the blades of each propeller 9 can have a variable pitch so as to be able to vary the amount of expelled water as required.

As regards operation, both when the watercraft 3 is moving and when it is motionless with the loader 1 lowered, water and floating substances are conveyed into said loader.

The continuous expulsion performed by the ejectors 8 causes a concentration on the bottom 5 of substances which are subsequently discharged into the watercraft 3 by overturning the loader 1.

Figure 3:
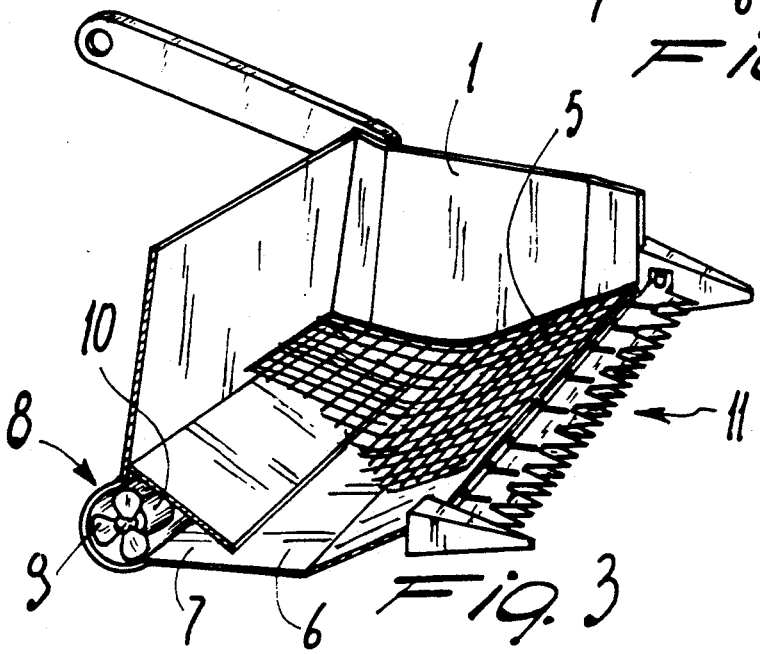
FIG. 3 is a partially sectional perspective view of the bucket according to the invention.
Figure 4:
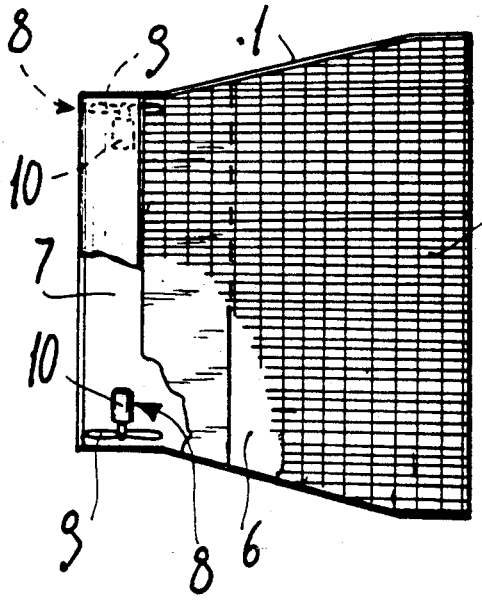
FIG. 4 is a top view of the bucket according to the invention.

As can be seen in FIGS. 2 and 3, a continuously- or discontinuously-moving, oleodynamically- or mechanically-actuated cutter 11 is fixed in front of the loader 1 for cutting the algae or other aquatic vegetation so as to facilitate the collection thereof by means of the bucket.

Figure 5:
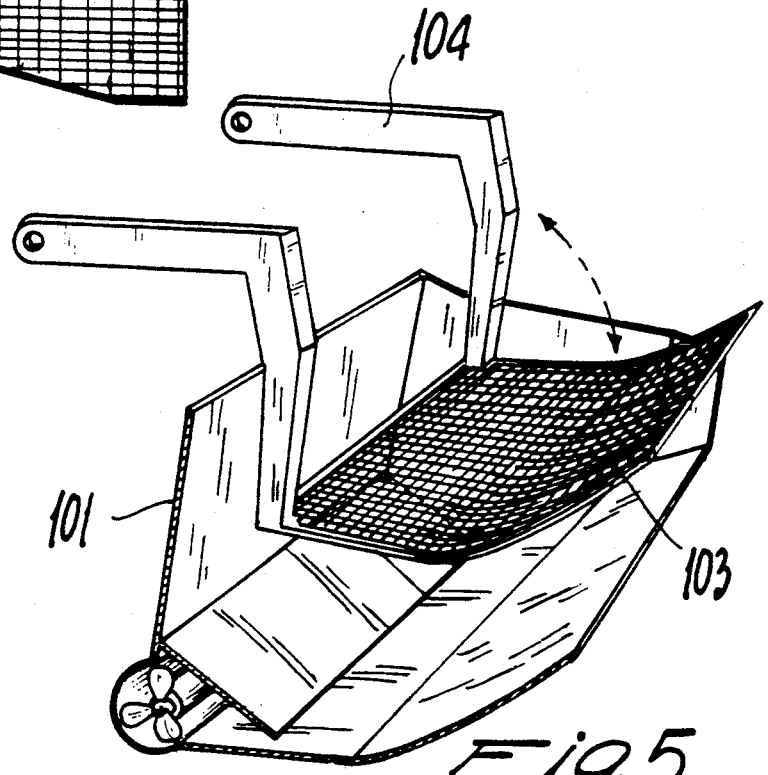
FIG. 5 is a view of a possible variation of the bucket according to the invention.

With reference now to the above FIG. 5, a variation of the bucket according to the invention provides a loader 101.

Said loader 101 differs from the preceding one in that the recovery of the material can occur with the simple movement and subsequent overturning of the internal sieve-like bottom 103 with independent arms 104 or with a continuous-discharge system which operates inside the bucket, for example by means of a conveyor belt.

Figure 6:
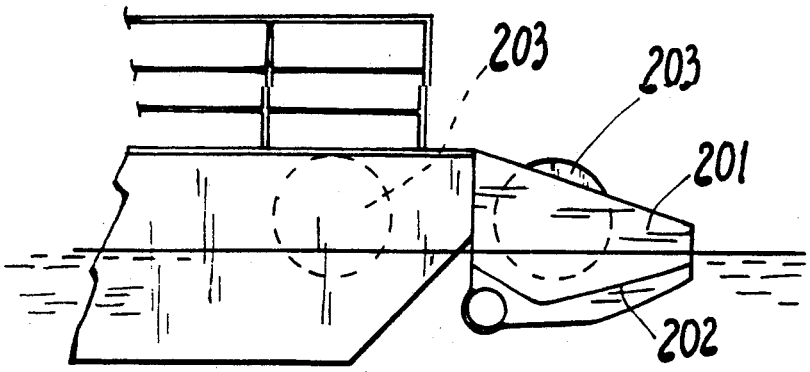
FIG. 6 is a schematic view of the bucket according to the invention, equipped with a device for separating oil-like substances from water.

A further variation illustrated in FIG. 6 is provided, inside the loader now designated by 201, above the sieve-like bottom 202, with a known unit 203 with partially submerged rotating disks for separating oil-like substances.

Conveniently, said disk unit 203 may also be arranged within the collection container arranged on the watercraft.

In practice it has thus been observed that the bucket according to the invention has achieved the intended aim and objects, since it is capable of collecting floating substances, such as algae or others, separating them from the water and then discharging them into a collection container.

The bucket is structurally simple and can thus be manufactured without particular problems.

The invention thus conceived is susceptible to numerous modifications and variations, all of which are within the scope of the inventive concept.

All the details may furthermore be replaced with other technically equivalent elements.

In practice, the materials employed, so long as compatible with the contingent use, as well as the dimensions, may be any according to the requirements.

I claim:

1. A watercraft bucket for collecting floating materials, comprising:

a loader bucket having a lower section and a rear wall and side walls extending upwardly from said lower section, said loader bucket also having an open front;

means for connecting said loader bucket to a powered watercraft so that, when the watercraft is floating on a water surface, said lower section is submerged beneath the water surface and said rear and side walls are partially submerged under the water surface, and the water surfaces passes through said open front of said loader bucket;

a sieve bottom arranged at said lower section of said loader bucket for collecting floating materials while allowing water to pass therethrough;

at least one ejector means connected to said loader bucket and arranged below and rearwardly of said sieve bottom for drawing water through said sieve bottom and out of said loader bucket; and means for removing material from the loader bucket and into the watercraft.

2. The watercraft bucket of claim 1, wherein said lower section has a concave shape and is provided rearwardly with a double channel system comprising a plate connected to said rear wall of said loader bucket and extending therefrom between said sieve bottom and an underlying depression chamber in which said ejector means is located, a longitudinal passage being defined between said lower section and an edge of said plate and extending along the width of said lower section for passage of water therethrough, said depression chamber being cylindrical with a pair of outlets arranged laterally and at opposite sides of said loader bucket, said ejector means comprising a pair of propellers each arranged at a respective one of said outlets.

3. The watercraft bucket of claim 2, wherein said propellers are driven by variable-speed hydraulic motors and are provided with variable pitch blades.

4. The watercraft bucket of claim 1, wherein said loader bucket comprises a pair of arms, and wherein said means for connecting said loader bucket tot he watercraft comprise means for pivotally connecting said pair of arms to the watercraft.

5. The watercraft bucket of claim 1, wherein said means for connecting said loader bucket to the watercraft comprise means for rigidly connecting said loader bucket to the watercraft, said sieve bottom comprising a pair of arms, the watercraft bucket further comprising mean for pivotally connecting said pair of arms to said watercraft.

6. The watercraft bucket of claim 1, further comprising an oil separating unit with rotating disks.

7. The watercraft bucket of claim 1, further comprising means for cutting floating materials and means for connecting said means for cutting to said loader bucket below said open front thereof.

* * * * *